US006717041B1

(12) United States Patent
Hilliard

(10) Patent No.: US 6,717,041 B1
(45) Date of Patent: Apr. 6, 2004

(54) TUNING ADJUSTMENT RETAINING MECHANISM

(75) Inventor: Greg Hilliard, Delavan, WI (US)

(73) Assignee: G. Leblanc Corporation, Kenosha, WI (US)

( * ) Notice: Subject to any disclaimer, the term of this patent is extended or adjusted under 35 U.S.C. 154(b) by 0 days.

(21) Appl. No.: 10/409,245

(22) Filed: Apr. 8, 2003

(51) Int. Cl.[7] ..... G10D 9/04
(52) U.S. Cl. ..... 84/394; 84/395
(58) Field of Search ..... 84/394, 395, 399, 84/387 A

(56) References Cited

U.S. PATENT DOCUMENTS

| | | | | |
|---|---|---|---|---|
| 1,232,069 A | | 7/1917 | Nelson | |
| 1,328,038 A | | 1/1920 | Enders | |
| 1,509,104 A | | 9/1924 | Hickemell | |
| 1,724,632 A | | 8/1929 | Acheson | |
| 1,764,562 A | | 6/1930 | Gulick | |
| 2,132,329 A | | 10/1938 | Todt | |
| 2,181,346 A | | 11/1939 | Selmer | |
| 2,734,417 A | | 2/1956 | Hindsley | |
| 2,790,345 A | | 4/1957 | Greenleaf | |
| 2,987,950 A | | 6/1961 | Kent | |
| 2,990,744 A | | 7/1961 | Brilhart | |
| 3,030,846 A | | 4/1962 | Greenleaf | |
| 3,329,056 A | | 7/1967 | Kostenko | |
| 3,835,748 A | | 9/1974 | Olson | |
| 3,933,079 A | | 1/1976 | Gillespie | |
| 4,341,146 A | * | 7/1982 | Massa | 84/381 |
| 4,559,859 A | | 12/1985 | Pilczuk | |
| 5,644,095 A | | 7/1997 | Davidson | |
| 6,008,443 A | * | 12/1999 | Honorato Ibanez | 84/387 R |

OTHER PUBLICATIONS www.ronniebousic.com.*

* cited by examiner

*Primary Examiner*—Kimberly Lockett
(74) *Attorney, Agent, or Firm*—Barnes & Thornburg

(57) ABSTRACT

Disclosed is a mechanism for attaching a tuning bell of a musical instrument to the musical instrument. The mechanism includes a rail attached to the tuning bell and a hollow channel attached to a part of the musical instrument such as, for example, to a valve cluster. The channel has an exterior surface and an interior surface. The mechanism includes an adjustable clamp engaging the exterior surface of the channel. Also disclosed is method of using the mechanism which comprises the steps of positioning the rail within the channel and adjusting the clamp to compressibly engage the interior surface of the channel against the exterior surface of the rail until the rail is secured against the interior surface to prevent movement of the rail within the channel.

12 Claims, 3 Drawing Sheets

TUNING ADJUSTMENT RETAINING MECHANISM

BACKGROUND AND SUMMARY

Wind musical instruments may require the use of a tuning bell to help adjust and maintain the proper tuning of the instrument. An attachment mechanism is used to attach the tuning bell to the instrument, for example, to the valve cluster of a trumpet. Prior art attachments include a rail attached to the instrument's valve cluster. A channel rides along the rail and can be tightened by use of small allen screw to lock the tuning bell in a desired position. A problem with this prior art device is that the set screws extend through the channel and abut the rail. The holding force of the screw through the channel pressing against the rail tends to cause the channel to deform outwardly away from the rail which may cause it to not provide a secure attachment. Another problem is that an additional clamp may need to be attached to the rail to help retain the tuning bell in a desired location. This additional clamp increases the attachment's cost and complexity. Also, some prior art attachment mechanisms position a securing screw where it may partially obstruct or at least interfere with access to the instrument's valves which could impede proper operation of the instrument. Wind instruments include brass winds such as trumpets, trombones, euphoniums, tubas and related instruments and wood winds such as saxophones, bassoons, and contra altos.

The present disclosure relates to a mechanism for attaching the tuning bell to the instrument. The mechanism includes a channel attached to the instrument and a rail attached to the tuning bell. The rail is designed to fit securely within the channel. A clamping mechanism is used to compress the channel to adjustably engage the rail when the rail is positioned in the channel. A tightening screw is used to adjust the compressing force of the clamping mechanism.

Because the attachment mechanism uses a compressible clamping structure, substantial forces can be applied to the channel and rail without deforming any of the structures. Further, the clamping mechanism provides sufficient force to obviate the need for a second clamp or screw. Optionally, for added stability and support, an extending support extending from the clamping mechanism to a mouthpiece receiving tube may be used.

Also disclosed is a method of securing the tuning bell of a wind musical instrument to the musical instrument. A rail attached to the tuning bell is positioned within a cavity defined by a hollow channel attached to the instrument. The channel is then compressibly tightened to engage the rail by two arms of a clamping mechanism which are brought together using a tightening screw.

Additional features will become apparent to those skilled in the art upon consideration of the following detailed description of drawings exemplifying the disclosure as presently perceived.

BRIEF DESCRIPTION OF THE DRAWINGS

The detailed description particularly refers to the accompanying figures in which.

DETAILED DESCRIPTION OF THE DRAWINGS

Figure 1:
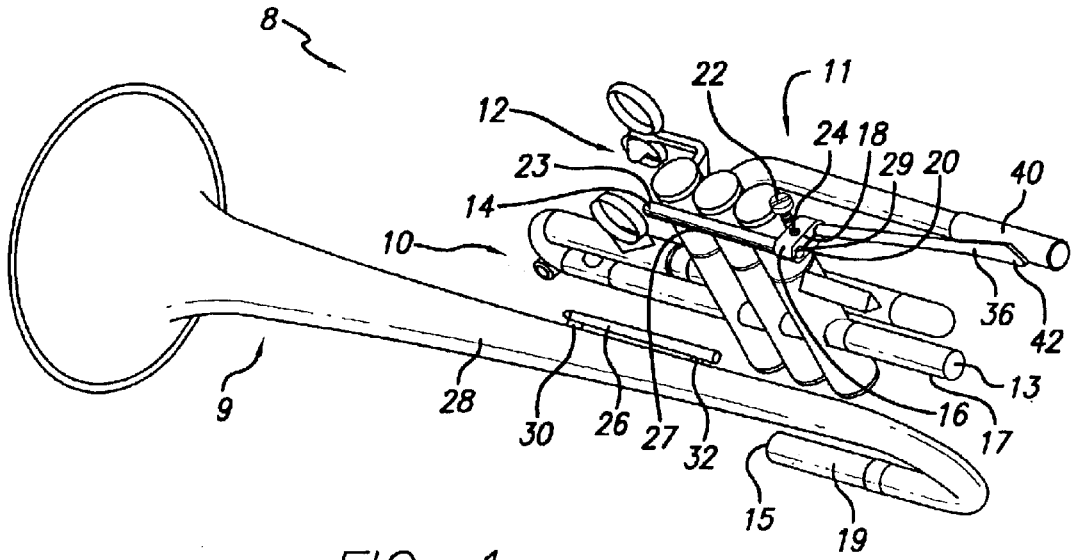
FIG. 1 is a perspective view of a brass wind instrument with a tuning bell displaced from a body portion and including the tuning adjustment retaining mechanism as disclosed.

While the present disclosure may be susceptible to embodiment in different forms, there is shown in the drawings, and herein will be described in detail, embodiments with the understanding that the present description is to be considered an exemplification of the principles of the disclosure and is not intended to limit the disclosure to the details of construction and the arrangements of components set forth in the following description or illustrated in the drawings.

With reference to the figures, FIG. 1, shows one embodiment of a wind musical instrument 8. In FIG. 1, a tuning bell 9 has been removed from a body 11 of the instrument 8. As shown, a male end 15 is engaged in a female end 13. A length 17 of the female end 13 extends into a corresponding portion 19 of the male end 15 to provide a degree of slideable adjustment of the tuning bell 9 of the instrument 8. A tuning adjustment retaining mechanism 10 of the current disclosure may be used with a variety of wind instruments including trumpets, trombones, euphoniums, tubas, saxophones, bassoons, and contra altos.

While it is not specifically illustrated, it is envisioned that the disclosed tuning retaining assembly 10 may be used in conjunction with a variety of wind instruments such as saxophones, bassoons, contra altos and others in order to retain a desired adjustment. A variety of musical instruments 8 include a valve cluster 12 (See FIG. 2). A commonly found three-valve valve cluster 12 of a trumpet is shown for illustrative purposes. The mechanism 10 includes a hollow channel 14 attached to valve cluster 12. A clamping assembly 16 is provided and includes a first clamp arm 18, a second clamp arm 20, and a compressor or clamp tightener 22, in the form of a threaded screw. The screw 22 passes through a pass hole or aperture 24 in upper clamp arm 18 into a lower threaded bore in lower clamp arm 20. The aperture 24 has a diameter slightly larger than a major diameter of screw 22. The screw 22 is used to tighten or loosen the compressing force, created by the clamp arms 18, 20.

Figure 4:
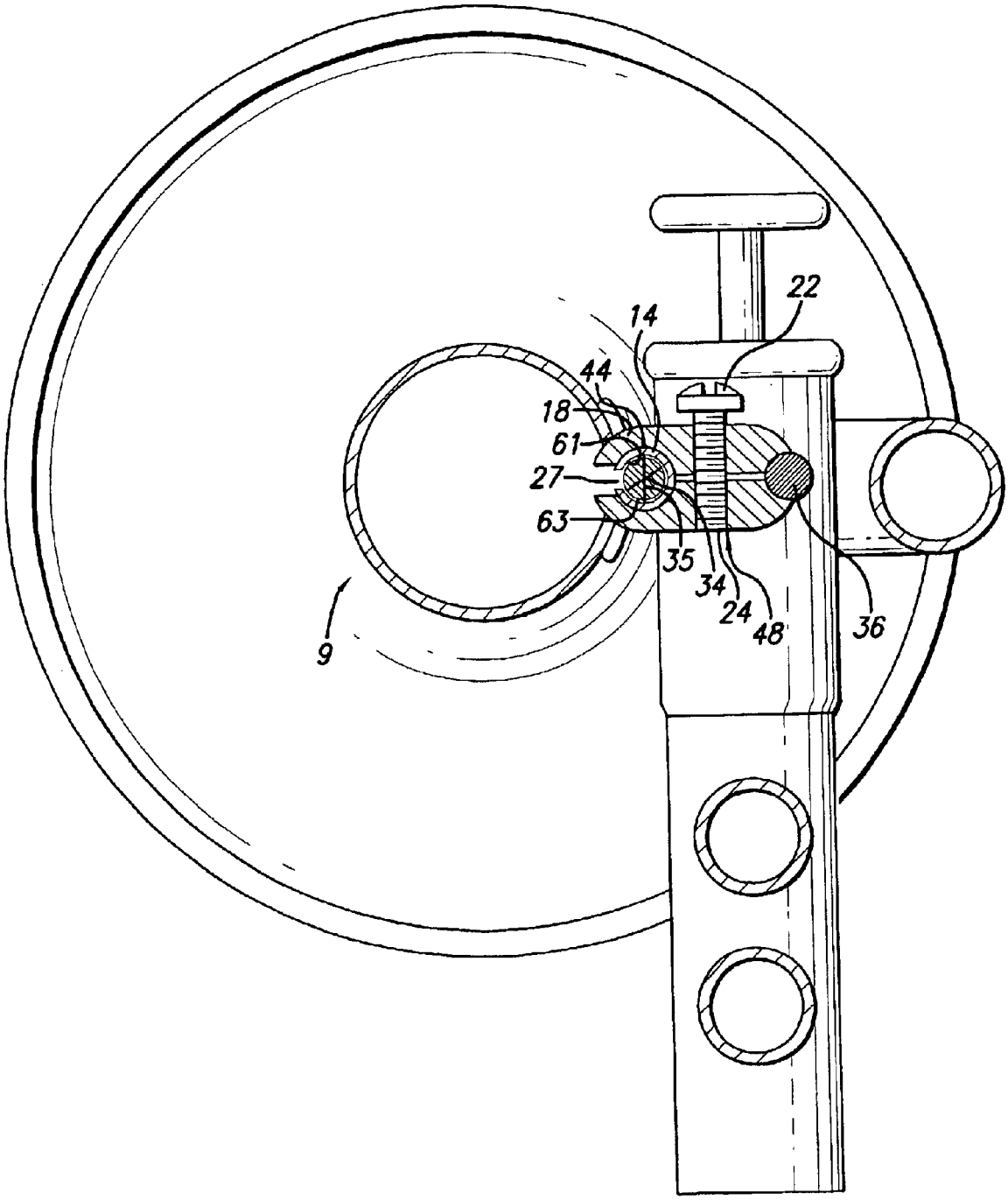
FIG. 4 is a partial fragmentary cross-sectional view of a portion of the mechanism taken along line 4—4 in FIG. 3.

A rail 26 is attached to a tuning bell tube 28 by attachment structures or posts 30, 32 which space the rail 26 away from the tubing bell. Attachment structures 30, 32 may be any suitable structure such as, for example, a welded member having a wider curved portion for engagement with the curve of the tuning bell tube 28 and a narrower curved portion for connection to rail 26. With reference to FIG. 4, rail 26 has an external cross-sectional shape which generally corresponds to the internal cross-sectional shape of the channel 14. While a generally circular cross-sectional shape is shown, other cross-sectional configurations are contemplated within the scope of this disclosure. Rail 26 has an exterior diameter 34 which is generally equal to or slightly smaller than the internal diameter 35 of the channel 14. The length of rail 26 depends on the type of the wind instrument rail 26 is used with, but as shown may be generally proportional to the length of the valve cluster 12. Rail 26 and channel 14 are generally the same length.

Figure 2:
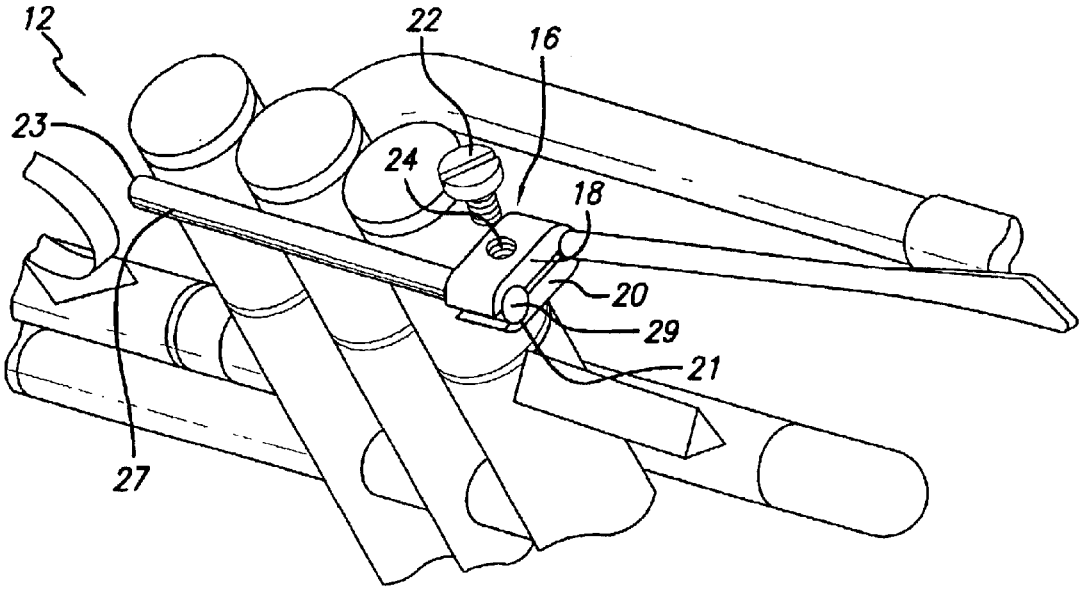
FIG. 2 is an exploded view of a valve cluster of FIG. 1.

Referring to FIG. 2, channel 14 includes a first end 21 and a second end 23 and further includes a wall 25 between the interior and exterior surfaces of the channel 14. Wall 25 includes a slot 27 which may extend a partial distance from the first end 21 toward the second end 23 or extend then entire length of the channel 14 from the first end 21 to the second end 23. The interior surface of wall 25 defines a cavity 29 into which rail 26 is positioned during attachment as more fully described below.

An extension member 36 is attached to a clamping assembly 16 and a mouthpiece tube 40 for added stability and support. An end portion 42 of extension 36 may be fanned or widen and curve to provide conformal attachment to mouthpiece tube 40.

Figure 3:
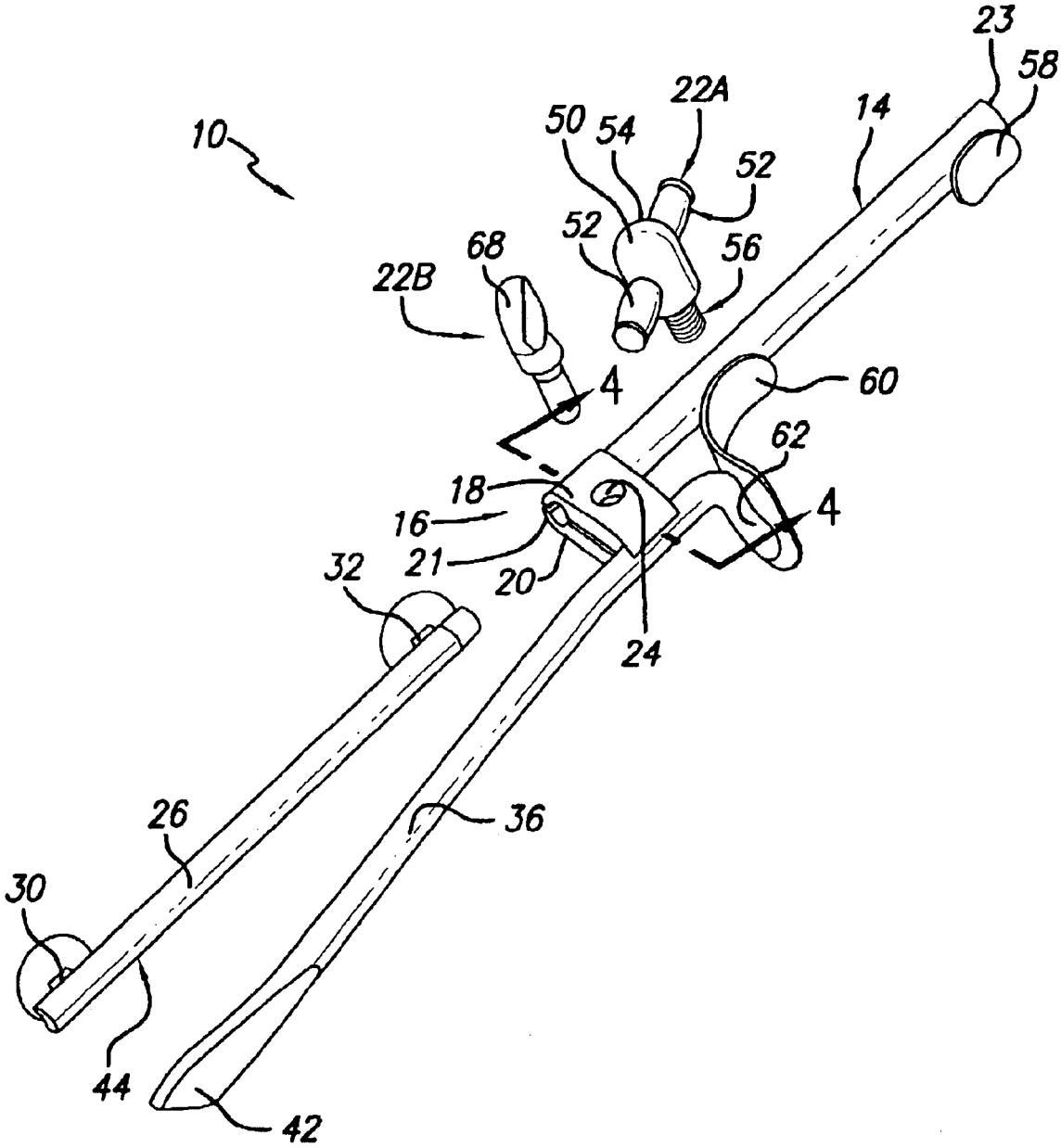
FIG. 3 is an enlarged exploded perspective view of the mechanism as shown in FIG. 1.

FIG. 3 shows the components of the mechanism 10 removed from the tuning bell tube 28 and valve cluster 12. Clamping assembly 16 has the upper clamp arm 18 and lower clamp arm 20, the interior surfaces of which engage the exterior surface 44 of channel 26. In one embodiment, aperture 24 extends through upper clamping arm 18 formed to receive an adjusting screw 22. A receiving bore 48 in lower clamp arm 20 is formed to receive an end of adjusting screw 22 as adjusting screw 22 is tightened.

The aperture 24 and recessed bore 48 are threaded for threaded engagement with a clamping screw 22, 22A or 22B. Clamping screw 22 as shown in FIG. 1, has a slotted head portion designed for engagement with a coin or standard screwdriver. Referring to FIG. 3, clamping screw 22A has a handle 50 with two arms 52 extending collinearly from a head portion 54. Arms 52 are so designed for easy gripping to produce the desired rotation. A threaded shank 56 extends down from the head portion 54 perpendicularly from the two arms 52 to pass through aperture 24.

Channel 14 is connected to the valve cluster 12 by attachment structure 58 which may be curved to provide conformal attachment. A wider curved attachment structure 60 connects extension member 36 to the valve cluster 12. An extension member end portion 62 may be bent to produce a larger surface for attachment to attachment structure 60.

The structures as described here and above provide the function of retaining the tuning bell to which the rail 26 is attached in secure position relative to the body of the instrument which includes the valve cluster 12. The rail 26 is received in hollow cavity 29 defined by the interior surface 61 of the channel 14. The channel 14 includes a generally longitudinally extending slot 27 which provides some degree of flexion of opposing ends of the slot. Flexion is promoted by the clamp arms 18, 20 which are engaged by the screw 22, 22A, 22B. This can be seen in FIG. 3. As shown in FIG. 4, clamp arms 18, 20 brought together by action of the screw to compress the interior surface 61 of the channel 14 against an exterior surface 63 of the rail 26. This clamping action produces a positive clamping force on both sides of the rail 26 by reducing diameter 35 to enhance the clamping action and securely retain the tuning bell tube 28 in proper adjustment. It should also be noted that the generally axially structure of the rail 26 and channel 14 result in extension of the clamping forces from the clamp assembly 16 extending therefrom a distance along the channel 14 and rail 26. The axially elongated structures of the rail 26 and channel 14 are in close generally conformal fitting of the exterior surface of the rail within the interior surface of the channel which tend to create frictional forces there between. The frictional forces help to enhance the engagement of the rail in the channel such that any canting is prevented.

The adjusting screw 22 may be hand tightened initially, and then securely tightened using a coin or slotted tool. Adjusting screw 22A allows for easier hand tightening by use of gripping arms 52. Curved adjusting screw 22B may also be hand tightened by gripping handle 68. The use of this clamping assembly 16 allows an operator to secure the rail 26 without a risk of over-tightening. The force of the clamping assembly 16 is distributed throughout the rail 26 such that the channel 14 cannot be deformed by manual over-tightening.

To remove the rail 26, the adjusting screw 22, 22A, 22B is rotated in a direction opposite the tightening direction. As the hollow cavity 29 widens, the rail 26 may be slid out from either end of the channel 14.

While an embodiment of the disclosure is shown and described, it is envisioned that those skilled in the art may devise various modifications and equivalents without departing from the spirit and scope of the disclosure as recited in the following claims.

What is claimed is:

1. A mechanism for adjustably attaching a tuning bell to a musical instrument, the mechanism comprising:

a rail attached to at least one of the tuning bell and the musical instrument;

a hollow channel attached to the other of the tuning bell and the musical instrument generally in opposition to the rail for receiving at least a portion of the rail therein;

the channel having an exterior surface and an interior surface; and an adjustable clamp coupled with the channel for compressibly engaging the exterior surface of the channel.

2. The mechanism of claim 1, wherein the channel is attached to the musical instrument and the rail is attached to the tuning bell.

3. The mechanism of claim 2, wherein the musical instrument includes a valve cluster and the channel is carried on the valve cluster.

4. The mechanism of claim 1, wherein the clamp includes an upper clamping arm and a lower clamping arm and a compressor on the upper and lower clamping arms for bringing the upper and lower arms together to produce compressing forces on the channel.

5. The mechanism of claim 4, wherein the upper clamping arm has an aperture therethrough, wherein the lower clamping arm has a lower threaded bore therethrough, and wherein the compressor is a threaded shaft, extending through the aperture and the lower threaded bore for providing controllable compression of the arms engaging the channel.

6. The mechanism of claim 1, wherein the channel further comprises:

a first end and a second end;

a wall defined between the exterior surface and interior surface;

a slot in at least a portion of the wall extending from the first end at least a distance along the wall toward the second end.

7. The mechanism of claim 6, wherein the slot extends from the first end to the second end.

8. The mechanism of claim 6, wherein the rail has attachment structures to attach the rail to and space away from the tuning bell, the attachment structures extending through the slot when the rail is in the channel.

9. A mechanism for adjustably attaching a tuning bell to a musical instrument, the mechanism comprising:

a rail attached to the tuning bell;

a hollow channel attached to the musical instrument generally in opposition to the rail for receiving at least a portion of the rail therein;

an adjustable clamp coupled with the channel for compressibly engaging the exterior surface of the channel;

the channel further comprising:

an exterior surface and an interior surface;

a first end and second end;

a wall defined between the exterior surface and the interior surface;

a slot in at least a portion of the wall extending from a first end and at least a distance along the wall toward the second end; and wherein the rail has attachment structures to attach the rail to and space away from the tuning bell, the attachment structures extending through the slot when the rail is in the channel.

10. The mechanism of claim 9, wherein the clamp includes an upper clamping arm and a lower clamping arm and a compressor on the upper and lower clamping arms for bringing the upper and lower arms together to produce compressing forces on the channel.

11. The mechanism of claim 10, wherein the upper clamping arm has an aperture therethrough, wherein the lower clamping arm has a lower threaded bore therethrough, and wherein the compressor is a threaded shaft, extending through the aperture and the lower threaded bore for providing controllable compression of the arms engaging the channel.

12. A method of adjustably securing a tuning bell of a musical instrument, the mechanism having a rail attached to at least one of the tuning bell and the musical instrument, a hollow channel attached to the other of the tuning bell and the musical instrument generally in opposition to the rail for receiving at least a portion of the rail therein, the having an exterior surface and an interior surface, and an adjustable clamp coupled with the channel for compressibly engaging the exterior surface of the channel, the method comprising the steps of:

positioning the rail within the channel;

adjusting the clamping mechanism to compressibly engage the exterior surface until the rail is secured against the interior surface to prevent movement of the rail within the channel.

* * * * *